US008702308B2

(12) United States Patent
Ross

(10) Patent No.: US 8,702,308 B2
(45) **Date of Patent: *Apr. 22, 2014**

(54) REDUCED OPENING ELASTIC DRAWSTRING BAG

(75) Inventor: Michael A. Ross, Dallas, TX (US)

(73) Assignee: Poly-America, L.P., Grand Prairie, TX (US)

( * ) Notice: Subject to any disclaimer, the term of this patent is extended or adjusted under 35 U.S.C. 154(b) by 1109 days.

This patent is subject to a terminal disclaimer.

(21) Appl. No.: 12/262,027

(22) Filed: Oct. 30, 2008

(65) Prior Publication Data

US 2010/0111452 A1 May 6, 2010

(51) Int. Cl.
*B65D 33/28* (2006.01)

(52) U.S. Cl.
USPC ..... 383/75

(58) Field of Classification Search
USPC ..... 383/72
See application file for complete search history.

(56) References Cited

U.S. PATENT DOCUMENTS

| | | | | |
|---|---|---|---|---|
| 3,010,640 | A | 11/1961 | Kugler | |
| 3,029,853 | A | 4/1962 | Piazze | |
| 3,738,567 | A | 6/1973 | Ruda | |
| 4,762,430 | A | 8/1988 | Bullard | |
| 5,133,607 | A * | 7/1992 | Bonke | 383/75 |
| 5,265,962 | A | 11/1993 | Ogawa et al. | |
| 6,003,717 | A * | 12/1999 | Long | 220/495.11 |
| 6,059,458 | A | 5/2000 | Belias et al. | |
| 6,394,651 | B2 | 5/2002 | Jackson | |
| 6,585,415 | B2 | 7/2003 | Malaspina | |
| 6,921,202 | B2 | 7/2005 | Raterman | |
| 6,939,042 | B2 | 9/2005 | Rusnak et al. | |
| 6,994,469 | B2 * | 2/2006 | Sleight et al. | 383/43 |
| 7,137,737 | B2 * | 11/2006 | Schneider | 383/75 |
| 8,523,439 | B2 * | 9/2013 | Ross | 383/75 |
| 2001/0019638 | A1 * | 9/2001 | Fox et al. | 383/75 |
| 2006/0165319 | A1 | 7/2006 | Patridge et al. | |
| 2013/0301958 | A1 * | 11/2013 | Ross | 383/75 |

FOREIGN PATENT DOCUMENTS

| | | | |
|---|---|---|---|
| DE | 19636511 | A1 | 3/1998 |
| EP | 0978459 | A1 | 2/2000 |
| WO | WO 2006050576 | A1 | 5/2006 |

* cited by examiner

*Primary Examiner* — Gary Elkins
*Assistant Examiner* — Christopher Demeree
(74) *Attorney, Agent, or Firm* — Brandon J. Lee

(57) ABSTRACT

The present invention is directed toward an improved construction of an elastic drawstring trash bag. The elastic drawstring trash bag described herein is comprised of a plastic bag made from two panels. An elastic drawstring is provided within hems running along the top of the two panels. The upper opening of the elastic drawstring bag is reduced (when the bag is in a relaxed state) by decreasing the distance between the interior edges of the short seals used to weld the drawstrings and bag together. Like an ordinary non-elastic drawstring bag, the elastic drawstring is pulled through access cutouts centrally located along the upper edge of the bag. When the bag of the present invention is in a relaxed state, the reduced upper opening width of the elastic drawstring bag is therefore less than bag proper width, allowing a consumer to pull the elastic drawstring bag over the lip of a trash receptacle and allowing the elastic drawstrings to snugly fit around the trash can.

16 Claims, 3 Drawing Sheets

REDUCED OPENING ELASTIC DRAWSTRING BAG

CROSS-REFERENCE TO RELATED APPLICATIONS

Figure 1:
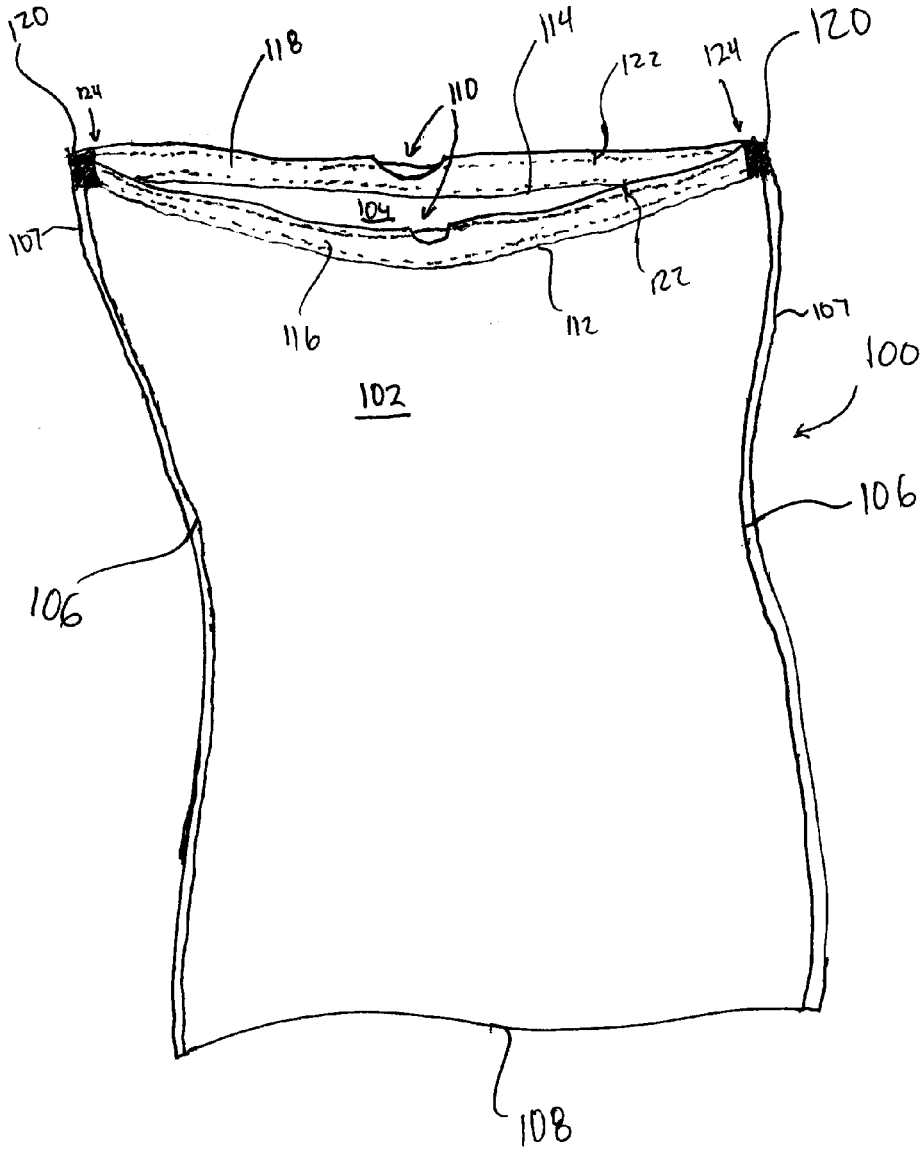

Not applicable.

BACKGROUND OF THE INVENTION

1. Field of the Invention

The present invention relates to improvements in the construction and manufacture of polymeric bags. In particular, the present invention relates to improvements in the construction and manufacture of drawstring-type polymeric bags, especially polymeric trash bags.

2. Description of the Related Art

Polymeric bags are ubiquitous in modern society. As a natural result of the widespread adoption and use of polymeric bags, the bags are available in a variety of different combinations of materials, capacities, thicknesses, dimensions and colors. Polymeric bags may be used in numerous ways including for long-term storage, food storage and trash collection. In response to consumer demand, manufacturers of polymeric bags have developed several innovations over the years to improve the utility and performance of polymeric bags. The present invention is of particular interest to the use of polymeric bags for trash collection and the methods for securely closing and carrying such trash bags, as well as applying such bags to trash receptacles.

While the polymeric trash bags available to consumers are available in a variety of different configurations, certain configurations are designed to cater to certain uses and particular segments of the population. When considering the utility of polymeric trash bags, one issue of primary concern to both consumers and manufacturers is how the consumer can securely close and carry the trash bag after filling the bag with debris. Securing the trash bag is of critical importance to containing the trash and other debris inside the trash bag when it is collected and transported. Over the years, the industry has developed several different methods for securely closing and carrying trash bags, each method having certain advantages and disadvantages.

A few common methods for securely closing and carrying trash bags are used in the vast majority of commercially-available trash bags. The most basic of these methods is to provide a twist-tie or similar strap to secure the top of the bag when it is bunched together. Another common method is to provide two or more flaps extending from the top of the trash bag which may be used for securely tying the top of the bag closed. A third common method for securely closing and facilitating carrying of a trash bag is to provide drawstrings near the top edges of the bag, generally located in the hems along the upper edges of the bag, which may be used to pull the upper opening of the trash bag closed.

One of the oldest methods for securing a trash bag is to provide a twist-tie to accompany the refuse bag. Twist-tie bags are usually straight-cut bags having an ordinary circular opening at the top of the bag. After the twist-tie bag is filled with trash and debris, the upper opening of the bag is bunched together and the twist-tie is used to hold the bunched up plastic at the top of the bag together to secure the bag for disposal. The twist-ties are typically constructed from a paper-covered semi-rigid wire, a self-securing plastic strap, or other materials. For the consumers, this method of closure can be inefficient, as the twist-ties need to be kept near the trash receptacle in a convenient location for securing the bag.

Therefore, alternative solutions were developed which integrate the means for closing and securing the bag opening into the bag design itself.

The flapped bag, also known as a wave-cut bag, refers to a particular configuration of polymeric bags where the top edges of the bag are cut in a wave-like pattern to provide two or more flaps extending upward from the top of the bag. These flaps allow the user to tie the opposing flaps together thereby securing the contents of the bag inside. When the opposing flaps are secured, the tied flaps also provide a convenient handle for carrying the filled bag. Flapped bags are generally more desirable and easier to use than twist-tie bags, but many consumers still do not find them as desirable as drawstring trash bags for general household use.

Drawstring trash bags are a popular alternative to the previously described twist-tie and flapped trash bags. As the name suggests, drawstring bags utilize drawstrings, also known as drawtapes, which are incorporated into the bag design. A pair of drawstrings is enclosed within hems running along the top edges, or upper opening, of the trash bag. The drawstrings are attached to the bag by a pair of short seals located near the upper corners of the bag. The short seals are created through a combination of heat and pressure to weld the two drawstrings and the panels of the drawstring bag together. Generally it is desirable to minimize the size of the short seals so as to not use extra plastic, which does not add any capacity to the bag.

After the bag is filled with trash, the drawstrings can be pulled through a pair of cutouts in the hems. These drawstrings can be tied together, securing the trash and providing a handle for carrying the filled bag. Despite the increased complexity of drawstring trash bags, the growing demand for drawstring trash bags provides the impetus for improvements for such bags, including the improvements disclosed herein.

Despite the popularity of drawstring bags, such bags are not without some criticism. In particular, many consumers find that the drawstring bags are difficult to secure over the upper lip of a trash receptacle. Therefore, it would be desirable to offer a drawstring trash bag that makes it easier to place the top of the drawstring bag over a trash receptacle. While the fit of a conventional drawstring trash bag over the upper lip of the receptacle may be sufficient in some cases to keep the drawstring bag secured onto the trash receptacle, the drawstring bag may still have a tendency to fall into the receptacle as the bag is filled. In fact, it is not uncommon for the weight of the trash in the bag to pull the upper opening of the bag down into the trash receptacle. Without some mechanism to provide a drawstring that is secured over the upper lip of the trash receptacle, the drawstring bag will always have a tendency to fall into the receptacle as garbage is thrown into the bag. Therefore, it would also be desirable to provide a drawstring that assists in securing the drawstring bag over the upper lip of a trash receptacle.

In the prior art, it was disclosed to utilize elastic materials as a component of the drawstring for a trash bag to provide a way to secure the upper part of the bag over the upper lip of a trash receptacle. In particular, prior art applications of elastic drawstring are disclosed which provide a pair of large notches at the upper corners of the bag used to pull the elastic drawstring outward from the sides of the bag. In such prior art embodiment, two elastic drawstring pieces are disposed within the hems which are the width of the upper edges of the trash bag. The two pieces of elastic drawstring are joined together at the respective ends of each drawstring to provide a continuous loop. Because of the elasticity of the drawstring, the continuous loop can be extended and fitted over the upper lip of a trash receptacle holding the bag in place. While this method may be effective in certain instances, it differs significantly from the typical configuration of a drawstring trash bag where the drawstring is pulled through the centrally located access cutouts along the upper edges of the bag. The awkward configuration of the prior art bag therefore detracts from its desirability.

Furthermore, the prior art elastic drawstring bag discussed above has disadvantages that make it less desirable in other respects as well. For example, the notches cut out of the top corners of the bag inherently result in substantial holes in the drawstring bag when closed for disposal. To better illustrate this point, the prior art bag can be compared to a traditional drawstring trash bag, the latter of which is closed by pulling the drawstrings through centrally located access cutouts. When the drawstrings are pulled through the centrally located access cutouts, the upper opening is reduced to a very small opening at the top of the bag. The small size of this single opening prevents smaller debris from falling out of the bag. Also, when the opposing drawstrings are tied together in a traditional drawstring trash bag, the drawstrings reduce the size of the hole and also cover the gap. In contrast, in the prior art elastic drawstring bags, the notches cut out of the upper corners of the bag result in substantial holes at the top sides of the bag when the drawstrings are pulled closed, which can result in debris and trash falling out. Furthermore, unlike the traditional drawstring trash bags, when the prior art elastic drawstring bag is tied, the tied drawstrings do not cover the substantial holes formed by the notches.

In view of the foregoing, it would be desirable to offer alternatives to elastic drawstring bags known in the prior art. It would be desirable for the alternatives to not require the awkward action of pulling the drawstring out from the corners of the bag, but would still allow the bag to be easily placed over the upper edge of the trash receptacle. Furthermore, it would be desirable for the alternatives to not have substantial holes in the bag when the drawstrings are tied, or secured, together. Additionally, it would be desirable for the consumers to be able to access the elastic drawstrings through access cutouts centrally located along the top of the bag as consumers are accustomed to with non-elastic drawstring trash bags. The present invention is intended to address these issues and desires.

SUMMARY OF THE INVENTION

The present invention is directed toward an improved construction of an elastic drawstring trash bag. The elastic drawstring trash bag is comprised of a polymeric bag which is made from a first panel and a second panel. A first hem is provided along the upper edge of the first panel. Similarly, a second hem is provided along the upper edge of the second panel. A first elastic drawstring is disposed within the first hem while a second elastic drawstring is disposed within the second hem.

The two elastic drawstrings are secured within their respective hems by a pair of short seals which are located proximately to the side seals of the bag along the upper edges. The innermost edges of the first and second short seals define the inner boundaries of the short seals. The upper opening width is defined by the distance between these inner boundaries.

One advantage and feature of the present invention is that the first and second elastic drawstrings of the present invention are not separable from the bag as disclosed in the prior art. This reduces the risk of an elastic drawstring, separated from the bag as in the prior art, catching on another object. Another advantage of the present invention is that it provides an elastic drawstring bag that is familiar to consumers of non-elastic drawstring bags. The elastic drawstring bags should look similar to non-elastic drawstring bags providing customers with familiarity and comfort in the purchase. Embodiments of the elastic drawstring bag contemplated by the present invention have an upper opening with a width that is less than 97% of the width of the rest of the bag (by virtue of the extended short seals). Another aspect of the present invention that is familiar to consumers is the inclusion of access cutouts centrally located along the first and second hems to allow access to the elastic drawstrings disposed within the hems.

It is contemplated that the present invention may be utilized in ways that are not fully described or set forth herein. The present invention is intended to encompass these additional uses to the extent such uses are not contradicted by the appended claims. Therefore, the present invention should be given the broadest reasonable interpretation in view of the present disclosure, the accompanying figures, and the appended claims.

BRIEF DESCRIPTION OF THE RELATED DRAWINGS

A full and complete understanding of the present invention may be obtained by reference to the detailed description of the present invention and preferred embodiment when viewed with reference to the accompanying drawings. The drawings can be briefly described as follows.

FIG. 1 provides a perspective view of the elastic drawstring trash bag as contemplated by the present invention.

Figure 2:
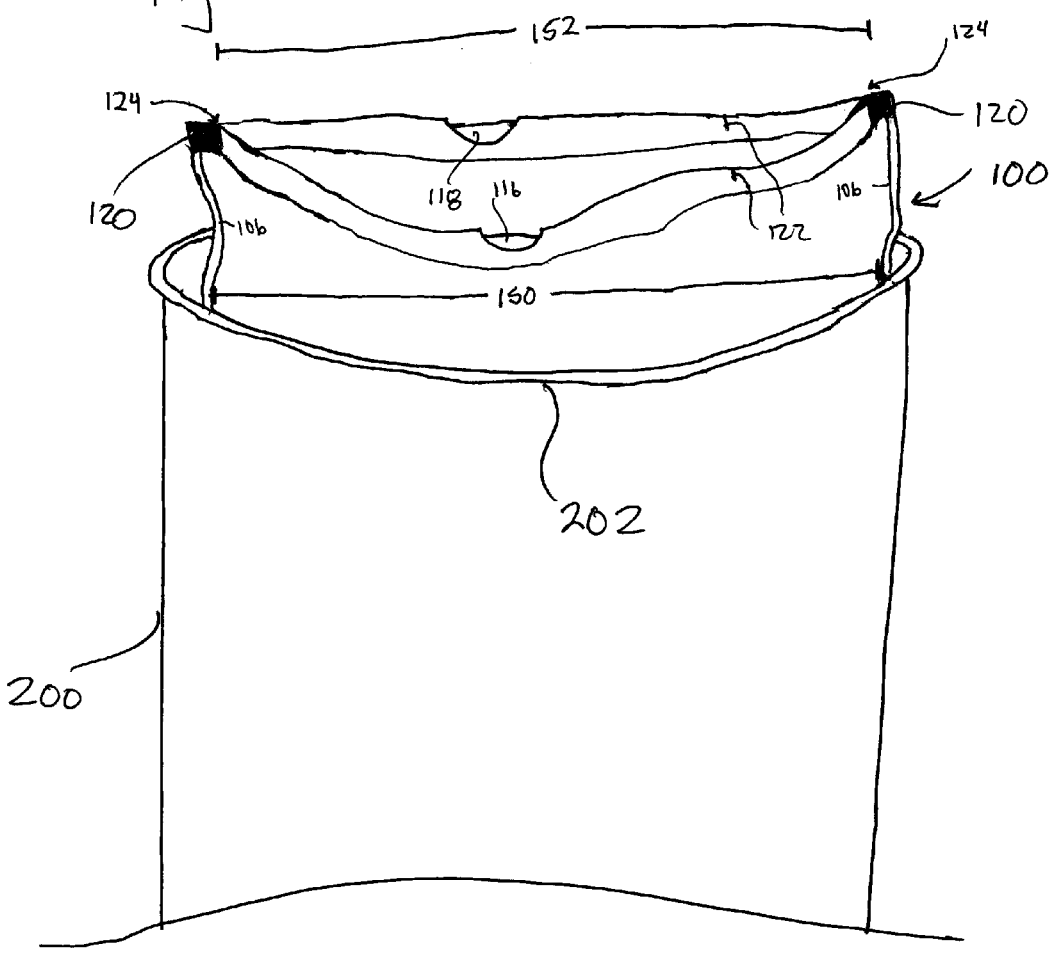

FIG. 2 provides a perspective view of the elastic drawstring trash bag as contemplated by the present invention in relation to a trash receptacle.

Figure 3:
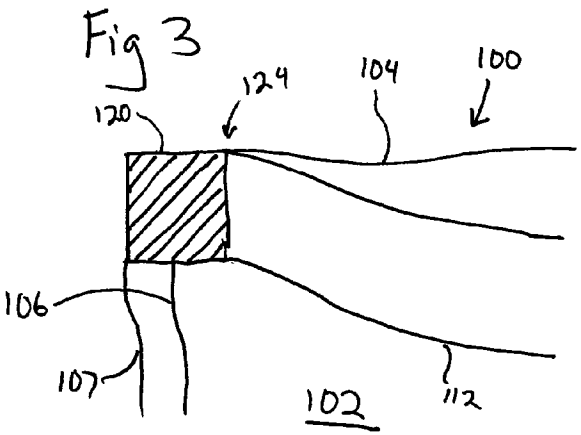

FIG. 3 provides a perspective view of an enlarged version of an upper corner of the elastic drawstring trash bag as contemplated by one embodiment of the present invention.

Figure 4:
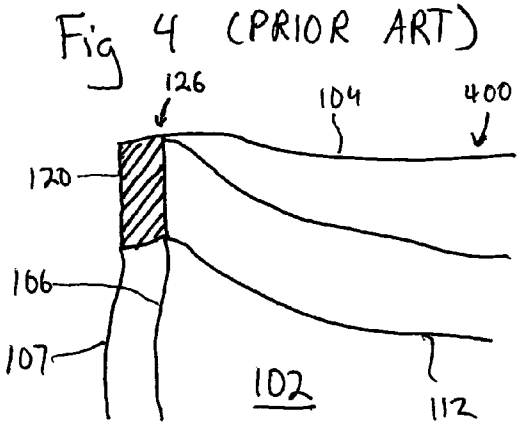
Fig 4 (PRIOR ART)

FIG. 4 provides a perspective view of an- enlarged version of an upper corner of a conventional non-elastic drawstring trash bag as known in the prior art.

Figure 5:
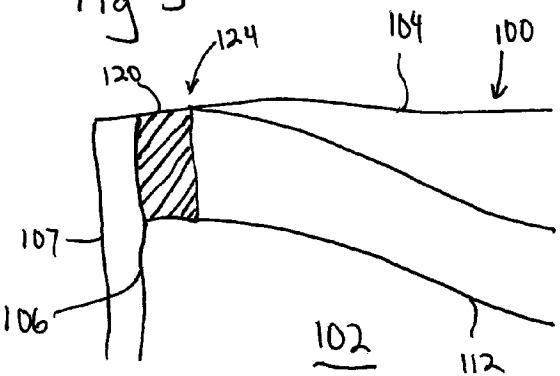

FIG. 5 provides a perspective view of an enlarged version of an upper corner of the elastic drawstring trash bag as contemplated by another embodiment of the present invention.

DETAILED DESCRIPTION OF THE INVENTION

The present disclosure illustrates one or more preferred embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms is not intended to conclusively limit the scope of protection.

Referring initially to FIG. 1, a perspective view of an elastic drawstring bag 100 is depicted to illustrate an embodiment of the present invention. In the depicted embodiment, the elastic drawstring bag 100 is manufactured from a first panel 102 and a second panel 104. The first and second panels 102 and 104 are joined at side seals 106 and bottom fold 108 to form the bag. Typically, the elastic drawstring bag 100 is manufactured using a blown-film extrusion process.

In a blown-film extrusion process, the first panel 102 and the second panel 104 are formed from an extruded polymeric tube, which is flattened as known in the art. Using a combination of transverse cuts and seals across the width of the flattened blown-film polymeric tube, a plurality of bags can be formed. Side seals 106 are formed in the bag, which result in a slight amount of excess polyethylene material to an edge 107 of the first panel 102 and second panel 104. While this construction method is the preferred method for manufacture, the invention disclosed herein is not necessarily limited to any particular manufacturing method.

Referring now back to FIG. 1, an tipper edge of the first panel 102 is folded over and sealed to form a first hem 112. Similarly, an upper edge of the second panel 104 is folded over and sealed to form a second hem 114. A first elastic drawstring 116 is disposed within the first hem 112 and runs across the width of the first panel 102. Similarly, a second elastic drawstring 118 is provided within the second hem 114 of the second panel 104 and runs substantially the width of the second panel 104. The first elastic drawstring 116 and the second elastic drawstring 118 are both preferably provided in a relaxed or substantially relaxed state.

The respective ends of the first elastic drawstring 116 and the second elastic drawstring 118 are secured within the hems 112 and 114 by a pair of seals, commonly known as the short seals 120. In general, as the area of the short seals 120 increases, the quality of the bond between the drawstrings 116 and 118 and the panels 102 and 104 should increase as well.

An enlarged view of an upper corner of a conventional non-elastic drawstring bag is shown in FIG. 4, as known in the prior art. An enlarged view of an upper corner of an embodiment of the present invention is also shown in FIG. 3 to better illustrate some of the differences. Looking first a FIG. 4, in conventional non-elastic drawstring bags, the width of the short seals 120 are minimized so as to not use extra plastic, which does not add any capacity to the bag. Therefore, with conventional non-elastic drawstring bags 400 it is undesirable and unnecessary to provide a short seal any larger than the distance from the edge 107 to the side seal 106 of the bag. The short seal 120 of the conventional non-elastic drawstring bags 400 end at interior edge 126, which is substantially aligned with the side seal 106 of the non-elastic drawstring bag 400.

In contrast to a conventional non-elastic drawstring bag 400, the short seals 120 of the elastic drawstring bag 100 depicted are widened. In the embodiment depicted in FIGS. 1, 2 and 3, the short seals 120 are shown extending from the edge 107, beyond the side seal 106, to an interior edge 124 of the short seal 120. Therefore, in the depicted embodiment, the width of the short seal 120 is substantially greater than the distance from the edge 107 to the side seal 106. However, as depicted in FIG. 5, it is contemplated that in certain other embodiments the short seals 120 may not be immediately adjacent to the edges 107 and may extend inward from the side seals 106 rather than from the edges 107.

Looking now back to FIGS. 1 and 2, other features of the present invention are disclosed. For example, in addition to the short seals 120, some embodiments of the present invention are also provided with a plurality of air ventilation slits/holes 122 to allow air built-up in the hem to escape during use. Without such air ventilation slits/holes 122, the hems could have a tendency to "bubble." As an additional advantage, the air ventilation holes 122 also permit the non-elastic polyethylene material to stretch and deform to a slightly greater degree as will be discussed below in more detail.

Unlike prior art elastic drawstring bags, some embodiments of the present invention contemplate an elastic drawstring bag 100 that includes central access cutouts 110 similar to those in conventional drawstrings bags. The central access cutouts 110 make the bag more familiar to a consumer, and the consumer can pull the elastic drawstrings 116 and 118 through the cutouts 110 to close the opening of the bag. In contrast to the prior art, for some embodiments of the present invention, the region of the short seals 120 are not separable from the remainder of the elastic drawstring bag 100.

In looking at both FIG. 1 and FIG. 2, it is important to note that one of the characteristics of the present invention is a reduction in the upper width 152 (when the bag is in a relaxed state) of the bag 100 resulting from the extended short seals 120. In the typical embodiment of the present invention as depicted, the elastic drawstring bag 100 has a bag proper width 150, roughly the distance between the side seals 106 of the elastic drawstring bag 100. The upper opening width 152 (when the bag is in a relaxed state) resulting from the extended short seals 120 is less than that of the bag proper width 150. In certain preferred embodiments of the present invention, the shorts seals 120 are positioned such that the ratio of the upper opening width 152 (when the bag is in a relaxed state) to the bag proper width 150 is less than 97%, but greater than 94%. In other embodiments, the ratio of the upper opening width 152 (when the bag is in a relaxed state) to the bag proper width 150 may be less than 94%.

In the depicted embodiment, the relaxed circumference of the upper opening is roughly two times the relaxed upper opening width 152 (when the bag is in a relaxed state), or two times the distance between the interior edges 124 of the short seals 120. Since the relaxed upper opening width 152 of the present invention is reduced compared to the bag proper width 150, the relaxed circumference of the upper opening for the depicted elastic drawstring bag 100 is less than the circumference of the upper opening for a conventional drawstring bag 400. Therefore, the relaxed circumference of the upper opening of the elastic drawstring bag 100 may be reduced to less than the circumference of the trash receptacle 200.

Referring now to FIG. 2, an elastic drawstring trash bag 100 as contemplated by one embodiment of the present invention is shown being placed onto a traditional trash receptacle 200. The trash receptacle 200, as is commonplace, has an upper lip 202 that is slightly smaller than the opening of a typical trash bag. In the conventional non-elastic drawstring trash bag 400, the width of a kitchen-sized bag is approximately 24 inches between side seals 106. Therefore the conventional non-elastic drawstring bags 400 have a circumferential opening of approximately 48 inches. Therefore, a kitchen sized trash receptacle 200 would typically have an upper lip 202 that is slightly less than 48 inches around thereby allowing the conventional non-elastic drawstring bag 400 to fit over the receptacle 200 but still provide a relatively tight fit.

Unlike non-elastic drawstring trash bags 400, the circumference of the upper opening of the depicted embodiment of an elastic drawstring trash bag 100 can be less than the circumference of the upper lip 202 of a trash receptacle 200. For the embodiment depicted in FIGS. 2, 3 and 5, the short seals 120 are positioned and sized to reduce the relaxed upper opening width 152 to less than the bag proper width 150. Therefore, when the elastic drawstring bag 100 is in its relaxed configuration, the circumference of the upper opening can be less than the upper lip 202 of the trash receptacle 200 due to the reduced upper opening width 152 between the interior edges 124 of the short seals 120. For non-elastic drawstring bags, it would be impossible to pull the non-elastic drawstrings over the upper lip 202 of the trash receptacle 200. However, with the elastic drawstrings 116 and 118, the elastic drawstring bag 100 of the present invention can be pulled over the upper lip 202.

The materials of the elastic drawstrings 116 and 118 are chosen to allow the elastic drawstrings 116 and 118 to be stretched over the upper lip 202 even with the reduced distance between the short seals 120. Thus, when the elastic drawstrings 116 and 118 are circumferentially stretched, the upper opening of the elastic drawstring bag 100 can easily be placed over the upper lip 202 of the trash receptacle 200.

In addition to facilitating the application of the bag over the upper lip 202 of a trash receptacle 200, the elastic drawstrings 116 and 118 also help to maintain the bag on the trash receptacle 200. In particular, when the elastic drawstrings 116 and 118 are stretched over the upper lip 202 of the trash receptacle 200 and released, the drawstrings 116 and 118 will contract and fit snugly around the trash receptacle 200.

As noted, the embodiments depicted herein are not intended to limit the scope of the present invention. Indeed, it is contemplated that any number of different embodiments may be utilized without diverging from the spirit of the invention. Therefore, the appended claims are intended to more fully encompass the scope of the present invention.

I claim:

1. An elastic drawstring trash bag comprising:

a polymeric bag comprised of a first panel and a second panel, the first panel and the second panel joined at a first side seal and a second side seal and a bottom, the first panel and the second panel each having an upper edge, a first hem formed in the first panel, the first hem having a first elastic drawstring disposed therein, a second hem formed in the second panel, the second hem having a second elastic drawstring disposed therein, a first short seal, the first short seal inseparably welding the first panel, the first elastic drawstring, the second panel and the second elastic drawstring together, an interior edge of the first short seal defined by the first short seal, a second short seal, the second short seal inseparably welding the first panel, the first elastic drawstring, the second panel and the second elastic drawstring together, an interior edge of the second short seal defined by the second short seal, a bag proper width defined by a distance between an interior edge of the first side seal and an interior edge of the second side seal, and a relaxed upper opening width defined by a distance between the interior edge of the first short seal and the interior edge of the second short seal when the bag is in a relaxed state, the relaxed upper opening width being less than the bag proper width.

2. The elastic drawstring bag of claim 1 wherein the first short seal and the second short seal are not within a notch or a cutout of the first panel and the second panel.

3. The elastic drawstring bag of claim 2 further comprising:

a first access cutout centrally located along the upper edge of the first panel and a second access cutout centrally located along the upper edge of the second panel, the first and second elastic drawstrings being accessible through the respective first and second access cutouts.

4. The elastic drawstring bag of claim 1 further comprising:

a first access cutout centrally located along the upper edge of the first panel and a second access cutout centrally located along the upper edge of the second panel, the first and second elastic drawstrings being accessible through the respective first and second access cutouts.

5. The elastic drawstring bag of claim 1, further comprising:

a ratio of the relaxed upper opening width to the bag proper width being less than 97%.

6. The elastic drawstring bag of claim 5, further comprising:

the ratio of the relaxed upper opening width to the bag proper width being greater than 94%.

7. The elastic drawstring bag of claim 6 further comprising:

a first access cutout centrally located along the upper edge of the first panel and a second access cutout centrally located along the upper edge of the second panel, the first and second elastic drawstrings being accessible through the respective first and second access cutouts.

8. The elastic drawstring bag of claim 5 wherein the first short seal and the second short seal are not within a notch or a cutout of the first panel and the second panel.

9. The elastic drawstring bag of claim 5, further comprising:

the ratio of the relaxed upper opening width to the bag proper width being less than 94%.

10. An elastic drawstring trash bag comprising:

a polymeric bag comprised of a first panel and a second panel, the first panel and the second panel joined at a first side, a second side, and a bottom, a first hem formed in the first panel, the first hem having a first elastic drawstring disposed therein, a second hem formed in the second panel, the second hem having a second elastic drawstring disposed therein, the first panel, the first elastic drawstring, the second panel, and the second elastic drawstring inseparably joined together at a first short seal and at a second short seal, and a first access cutout along the upper edge of the first panel and a second access cutout along the upper edge of the second panel, the first and second elastic drawstrings being accessible through the respective first and second access cutouts.

11. The elastic drawstring bag of claim 10, further comprising:

the first access cutout and the second access cutout being approximately equidistant between the first short seal and the second short seal along a top of the polymeric bag.

12. The elastic drawstring bag of claim 10, further comprising:

the ratio of a distance between the first seal and the second seal to a width of the bag proper being less than 97%.

13. The elastic drawstring bag of claim 10, further comprising:

the ratio of a distance between the first seal and the second seal to a width of the bag proper being greater than 94% but less than 100%.

14. The elastic drawstring bag of claim 10, further comprising:

the ratio of a distance between the first seal and the second seal to a width of the bag proper being between 94% and 97%, inclusive thereof.

15. The elastic drawstring bag of claim 14, further comprising:

the first access cutout and the second access cutout being approximately equidistant between the first short seal and the second short seal along a top of the polymeric bag.

16. An elastic drawstring trash bag comprising:

a polymeric bag comprising a first panel and a second panel, a first hem formed in the first panel and a second hem formed in the second panel, a first elastic drawstring disposed within the first hem and a second elastic drawstring disposed within the second hem, the first elastic drawstring having a first end that is substantially coterminous with a first end of the second elastic drawstring and a second end that is substantially coterminous with a second end of the second elastic drawstring, the first ends of the first and second elastic drawstrings inseparably joined to the first panel and the second panel at a first short seal, the second ends of the first and second elastic drawstrings inseparably joined to the first panel and the second panel at a second short seal, the distance between an interior edge of the first short seal and an interior edge of the second short seal being less than a bag proper width of the polymeric bag.

* * * * *